US006752672B2

(12) United States Patent
Kanno

(10) Patent No.: US 6,752,672 B2
(45) Date of Patent: Jun. 22, 2004

(54) FUEL INJECTION CONTROL FOR MARINE ENGINE

(75) Inventor: Isao Kanno, Hamamatsu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 106 days.

(21) Appl. No.: 10/113,317

(22) Filed: Mar. 29, 2002

(65) Prior Publication Data

US 2002/0164907 A1 Nov. 7, 2002

(30) Foreign Application Priority Data

Apr. 11, 2001 (JP) ..... 2001-112641
Sep. 21, 2001 (JP) ..... 2001-288522

(51) Int. Cl.[7] ..... B63H 21/21
(52) U.S. Cl. ..... 440/84; 440/1
(58) Field of Search ..... 440/1, 84

(56) References Cited

U.S. PATENT DOCUMENTS

| | | | |
|---|---|---|---|
| 4,385,601 | A | 5/1983 | Orova et al. |
| 4,492,197 | A | 1/1985 | Yamamoto et al. |
| 4,594,978 | A | 6/1986 | Kanno |
| 4,708,669 | A | 11/1987 | Kanno et al. |
| 4,734,065 | A | 3/1988 | Nakahama et al. |
| 4,767,363 | A | 8/1988 | Uchida et al. |
| 4,850,318 | A | 7/1989 | Torigai et al. |
| 4,898,137 | A | 2/1990 | Fujita et al. |
| 4,909,764 | A | 3/1990 | Hirukawa et al. |
| 4,951,640 | A | 8/1990 | Hirukawa et al. |
| 5,056,483 | A | 10/1991 | Ohuchi |
| 5,117,792 | A | 6/1992 | Kanno |
| 5,136,279 | A | 8/1992 | Kanno |
| 5,170,065 | A | 12/1992 | Shimizu et al. |
| 5,450,828 | A | 9/1995 | Sakamoto et al. |
| 5,606,952 | A | 3/1997 | Kanno et al. |
| 5,615,645 | A | 4/1997 | Kanno |
| 5,669,349 | A | 9/1997 | Iwata et al. |
| 5,782,659 | A | 7/1998 | Motose |
| 5,941,743 | A | 8/1999 | Kato |
| 5,970,951 | A | 10/1999 | Ito |
| 6,019,090 | A | 2/2000 | Ozawa |
| 6,079,389 | A | 6/2000 | Ono et al. |
| 6,135,918 | A | 10/2000 | Bellinger et al. |
| 6,223,723 | B1 | 5/2001 | Ito |
| 6,325,046 | B1 | 12/2001 | Kanno |
| 2001/0001955 | A1 | 5/2001 | Kanno |
| 2001/0036777 | A1 | 11/2001 | Iida et al. |

*Primary Examiner*—Jesus D. Sotelo
(74) *Attorney, Agent, or Firm*—Knobbe, Martens Olson & Bear, LLP

(57) ABSTRACT

A watercraft has an engine that is controlled to reduce the likelihood of engine damage when the watercraft engine speed is rapidly increased due to a lack of load on the propulsion unit. The engine is controlled by a method that detects engine speed and reduces the power output of the engine by varying degrees depending on the speed of the engine relative to plural predetermine speeds.

22 Claims, 12 Drawing Sheets

FUEL INJECTION CONTROL FOR MARINE ENGINE

PRIORITY INFORMATION

This application is based on and claims priority to Japanese Patent Applications No. 2001-112641, filed Apr. 11, 2001, and No. 2001-288522, filed Sep. 21, 2001 the entire contents of which is hereby expressly incorporated by reference.

BACKGROUND OF THE INVENTION

The present application generally relates to an engine control arrangement for a watercraft, and more particularly relates to an engine management system that prevents engine damage due to excessive engine speeds.

DESCRIPTION OF THE RELATED ART

Watercraft, including personal watercraft and jet boats, are often powered by an internal combustion engine having an output shaft arranged to drive a water propulsion device. Occasionally, watercraft may leave the water at speed due to waves, thus causing sudden decreased load on the propulsion unit, which can raise the engine RPM to a damaging speed.

Watercraft often operate within three modes of operation: displacement mode, transition mode and planing mode. During lower speeds, the hull displaces water to remain buoyant; this is the displacement mode. At a particular watercraft speed relative to the water, a portion of the hull rises up from the water and the watercraft begins planing across the water; this is the planing mode. The transition mode occurs between the displacement mode and the planing mode and involves the range of watercraft speeds between the planing and displacement modes.

While the watercraft is planing (i.e., up on plane), the wetted surface area of the watercraft is decreased and the water resistance is substantially reduced, increasing the likelihood that the propulsion unit will leave the water. On the other hand, once the watercraft slows to a speed that brings the watercraft off plane (i.e., transition mode and/or displacement mode), the wetted surface area of the watercraft is significantly increased and the likelihood of air entering the propulsion unit is dramatically decreased.

One way of protecting the engine against over-revving is to limit the spark plugs from firing, allowing the engine to slow down. In two cycle engines since the spark plugs are fired every stroke, if one firing cycle of a spark plug is stopped in order to slow down the engine, engine smoothness is not significantly compromised. However, in a four cycle engine the spark plugs are fired every second stroke, so when the firing of a spark plug is omitted a noticeable compromise in engine smoothness occurs. Additionally, in any exhaust system where an exhaust catalyst is used, the exhaust catalyst may be damaged due to unburned fuel entering the exhaust system since the fuel injectors continue to operate when the ignition spark is interrupted.

SUMMARY OF THE INVENTION

Accordingly, an engine control arrangement has been developed to better control engine speed during a decreased load on the propulsion unit in order to prevent engine damage as well as maintaining a smooth ride. In addition, the engine control arrangement can be configured to maintain a safe engine speed by controlling the fuel injection to varying individual cylinders or to all cylinders gradually.

Thus, one aspect of the present invention is directed to a method of controlling a marine engine associated with a watercraft. The method includes sensing a first engine speed and comparing the first sensed engine speed with a first predetermined speed. Fuel supply to the engine is reduced by a first delivery amount if the first sensed engine speed is above the first predetermined engine speed. The method also includes sensing a second engine speed after reducing fuel delivery by a first fuel amount and restoring fuel delivery by the first fuel amount if the second sensed engine speed is below a second predetermined engine speed that is greater than the first predetermined engine speed.

One aspect of the invention includes the realization that there are operating conditions under which a speed-limiting device can cut engine power when the engine exceeds a first speed, then restore engine power before the engine speed falls below the first speed, without over-revving the engine. This control scenario can allow the engine to operate at an elevated engine speed during a period of reduced load, such as for example but without limitation, when the watercraft jumps slightly out of the water at high speed. By allowing the engine to operate at the elevated speed, the re-entry of the watercraft into the water can be more smooth.

Another aspect of the present invention is directed to a watercraft comprising a hull and an engine disposed within the hull. The engine includes an engine body defining plural cylinders. An engine speed sensor is configured to detect a speed of the engine. The watercraft also includes a controller connected to the engine speed sensor and configured to control a power output of the engine. The controller is configured to detect a first engine speed and to reduce the power output of the engine if the first engine speed is greater than a first predetermined engine speed. Additionally, the controller is configured to detect a second engine speed, and restore the power output of the engine if the second engine speed is less than a second predetermined engine speed, which is greater than the first predetermined engine speed.

Further aspects, features and advantages of this invention will become apparent from the detailed description of the preferred embodiments which follow.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise fifteen figures in which.

DETAILED DESCRIPTION OF THE PREFERRED EMBODIMENT

With reference to FIGS. 1 to 6, an overall configuration of a personal watercraft 10 and its engine 12 will be described. The watercraft 10 employs the internal combustion engine 12, which is configured in accordance with a preferred embodiment of the present invention. The described engine configuration and the associated control routine have particular utility for use with personal watercraft, and thus, are described in the context of personal watercraft. The engine configuration and the control routine, however, also can be applied to other types of watercraft, such as, for example, small jet boats and other vehicles.

Figure 1:
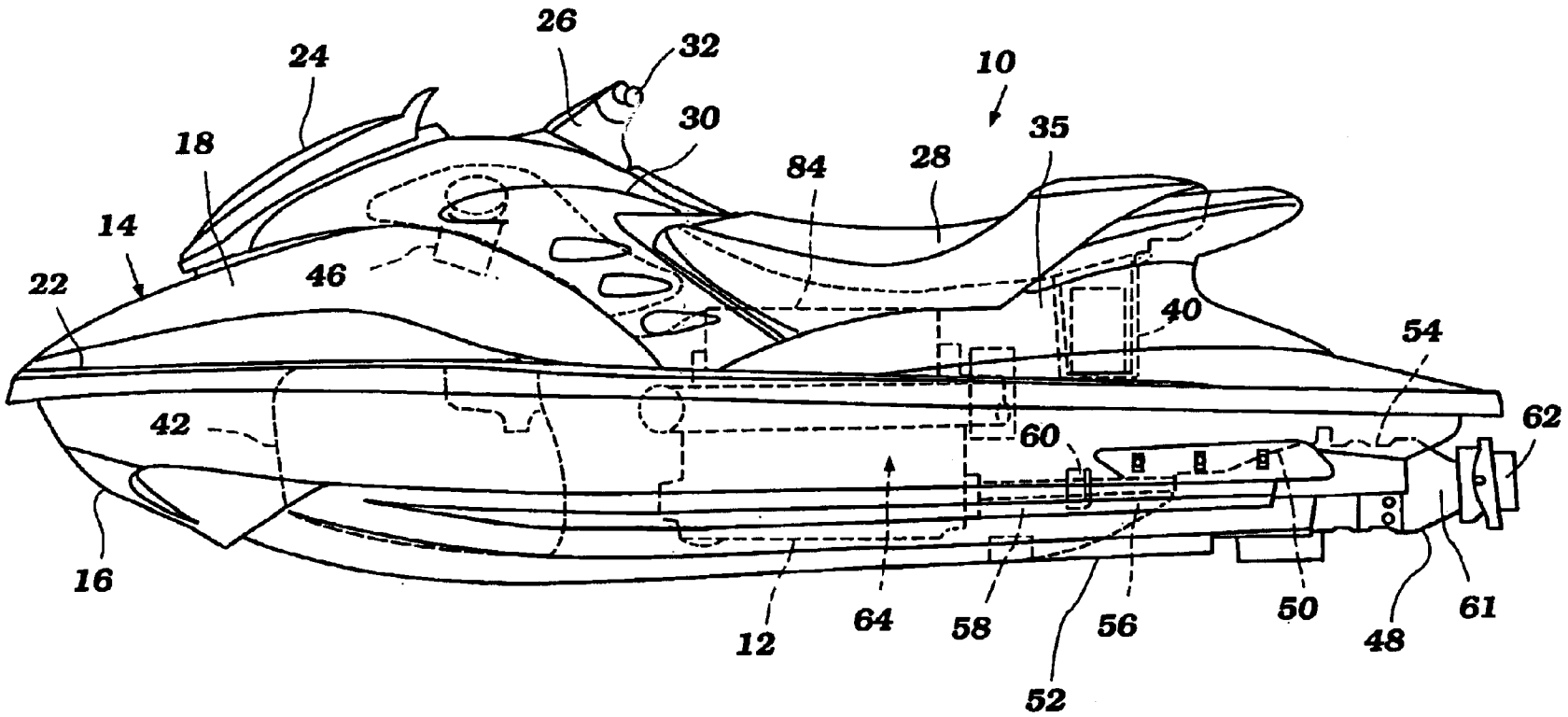
FIG. 1 is a side elevational view of a personal watercraft of the type powered by an engine controlled in accordance with certain features, aspects and advantages of the present invention. Several of the internal components of the watercraft (e.g., the engine) are illustrated in phantom.

With reference initially to FIG. 1, the personal watercraft 10 includes a hull 14 formed with a lower hull section 16 and an upper hull section or deck 18. The lower hull section 16 and the upper hull section 18 preferably are coupled together to define an internal cavity 20 (see FIG. 5). A bond flange 22 defines an intersection of both of the hull sections 16, 18.

The illustrated upper hull section 14 preferably comprises a hatch cover 24, a control mast 26 and a seat 28, which are arranged generally in seriatim from fore to aft.

In the illustrated arrangement, a forward portion of the upper hull section 18 defines a bow portion 30 that slopes upwardly. An opening can be provided through the bow portion 30 so the rider can access the internal cavity 20. The hatch cover 24 can be detachably affixed (e.g., hinged) to the bow portion 30 to resealably cover the opening.

The control mast 26 extends upwardly to support a handle bar 32. The handle bar 32 is provided primarily for controlling the direction of the watercraft 10. The handle bar 32 preferably carries other mechanisms, such as, for example, a throttle lever 34 that is used to control the engine output (i.e., to vary the engine speed).

The seat 28 extends rearwardly from a portion just rearward of the bow portion 30. The seat 28 is disposed atop a pedestal 35 defined by the deck 18 (see FIG. 1). In the illustrated arrangement, the seat 28 has a saddle shape. Hence, a rider can sit on the seat 28 in a straddle fashion.

Foot areas 36 are defined on both sides of the seat 28 along a portion of the top surface of the upper hull section 18. The foot areas 36 are formed generally flat but may be inclined toward a suitable drain configuration.

The seat 28 preferably is configured to close an access opening 38 formed within the pedestal 35. The access opening 38 generally provides suitable access to the internal cavity 20 and, in the illustrated arrangement, to the engine 12. Thus, when the seat 28 is removed from the pedestal 35, the engine 12 can be accessed through the opening 38. In the illustrated embodiment, the upper hull section 18 or pedestal 35 also encloses a storage box 40 that is disposed under the seat 28.

A fuel tank 42 is positioned in the cavity 20 under the bow portion 30 of the upper hull section 18 in the illustrated arrangement. A duct (not shown) preferably couples the fuel tank 42 with a fuel inlet port positioned at a top surface of the bow 30 of the upper hull section 18. A closure cap 44 (see FIG. 2) closes the fuel inlet port to inhibit water infiltration.

The engine 12 is disposed in an engine compartment defined, for instance within the cavity 20. The engine compartment preferably is located under the seat 28, but other locations are also possible (e.g., beneath the control mast or in the bow). In general, the engine compartment is defined within the cavity 20 by a forward and rearward bulkhead. Other configurations, however, are possible.

A pair of air ducts 46 are provided in the illustrated arrangement such that the air within the internal cavity 20 can be readily replenished or exchanged. The engine compartment, however, is substantially sealed to protect the engine 12 and other internal components from water.

A jet pump unit 48 propels the illustrated watercraft 10. Other types of marine drives can be used depending upon the application. The jet pump unit 48 preferably is disposed within a tunnel 50 formed on the underside of the lower hull section 16. The tunnel 50 has a downward facing inlet port 52 opening toward the body of water. A jet pump housing 54 is disposed within a portion of the tunnel 50. Preferably, an impeller (not shown) is supported within the jet pump housing 54.

An impeller shaft 56 extends forwardly from the impeller and is coupled with a crankshaft 58 of the engine 12 by a suitable coupling device 60. The crankshaft 58 of the engine 12 thus drives the impeller shaft 56. The rear end of the housing 54 defines a discharge nozzle 61. A steering nozzle 62 is affixed proximate the discharge nozzle 61. The steering nozzle 62 can be pivotally moved about a generally vertical steering axis. The steering nozzle 62 is connected to the handle bar 32 by a cable or other suitable arrangement so that the rider can pivot the nozzle 62 for steering the watercraft.

Figure 5:
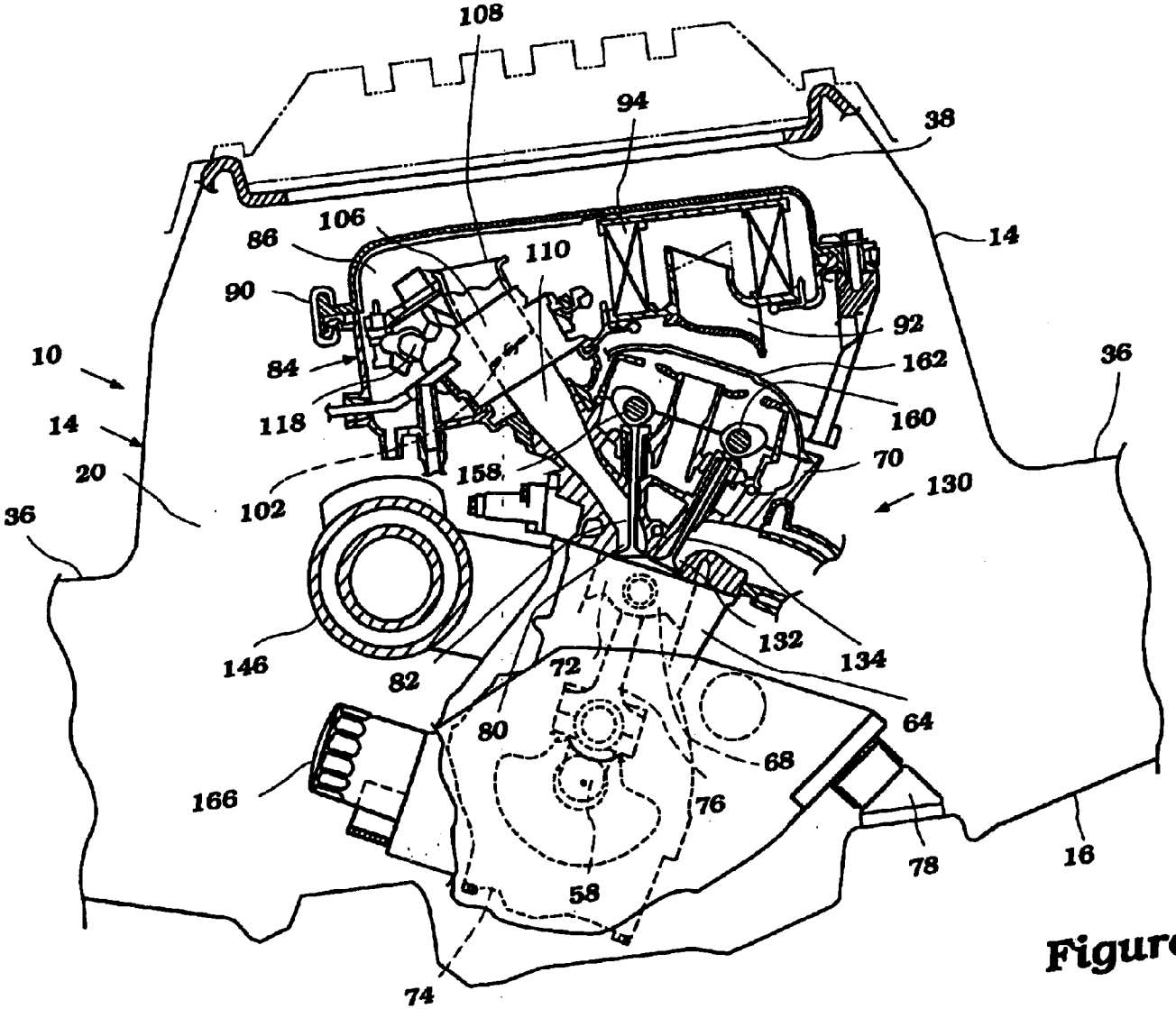
FIG. 5 is a schematic, cross-sectional rear view of the watercraft and the engine. A profile of a hull of the watercraft is shown schematically. Portions of the engine and an opening of an engine compartment of the hull are illustrated partially in section.

The engine 12 in the illustrated arrangement operates on a four-stroke cycle combustion principal. With reference to FIG. 5, the engine 12 includes a cylinder block 64 with four cylinder bores 66 formed side by side. The engine 12, thus, is an inclined L4 (in-line four cylinder) type. The illustrated engine, however, merely exemplifies one type of engine on which various aspects and features of the present invention can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable. Many orientations of the engine are also possible (e.g., with a transversely or vertically oriented crankshaft).

With continued reference to FIG. 5, a piston 68 reciprocates in each of the cylinder bores 66 formed within the cylinder block 64. A cylinder head member 70 is affixed to the upper end of the cylinder block 64 to close respective upper ends of the cylinder bores 66. The cylinder head member 70, the cylinder bores 66 and the pistons 68 together define combustion chambers 72.

A lower cylinder block member or crankcase member 74 is affixed to the lower end of the cylinder block 64 to close the respective lower ends of the cylinder bores 66 and to define, in part, a crankshaft chamber. The crankshaft 58 is journaled between the cylinder block 64 and the lower cylinder block member 74. The crankshaft 58 is rotatably connected to the pistons 68 through connecting rods 76. Preferably, a crankshaft speed sensor 77 is disposed proximate the crankshaft to output a signal indicative of engine speed. In some configurations, the crankshaft speed sensor 77 is formed, at least in part, with a flywheel magneto. The speed sensor 77 also can output crankshaft position signals in some arrangements.

The cylinder block 64, the cylinder head member 70 and the crankcase member 74 together generally define an engine block of the engine 12. The engine 12 preferably is made of an aluminum-based alloy.

Engine mounts 78 preferably extend from both sides of the engine 12. The engine mounts 78 can include resilient portions made of, for example, a rubber material. The engine 12 preferably is mounted on the lower hull section 16, specifically, a hull liner, by the engine mounts 78 so that the engine 12 is greatly inhibited from conducting vibration energy to the hull section 16.

The engine 12 preferably includes an air induction system to guide air to the combustion chambers 72. In the illustrated embodiment, the air induction system includes four air intake ports 80 defined within the cylinder head member 70. The intake ports 80 communicate with the four combustion chambers 72, respectfully. Other numbers of ports can be used depending upon the application.

Intake valves 82 are provided to open and close the intake ports 80 such that flow through the ports 80 can be controlled. A camshaft arrangement that can be used to control the intake valves 82 is discussed below.

The air induction system also includes an air intake box 84 for smoothing intake airflow and acting as an intake silencer. The intake box 84 in the illustrated embodiment is generally rectangular and, along with an intake box cover 86, defines a plenum chamber 88. The intake box cover 86 can be attached to the intake box 84 with a number of intake box cover clips 90 or any other suitable fastener. Other shapes of the intake box of course are possible, but the plenum chamber preferably is as large as possible while still allowing for positioning within the space provided in the engine compartment.

Figure 6:
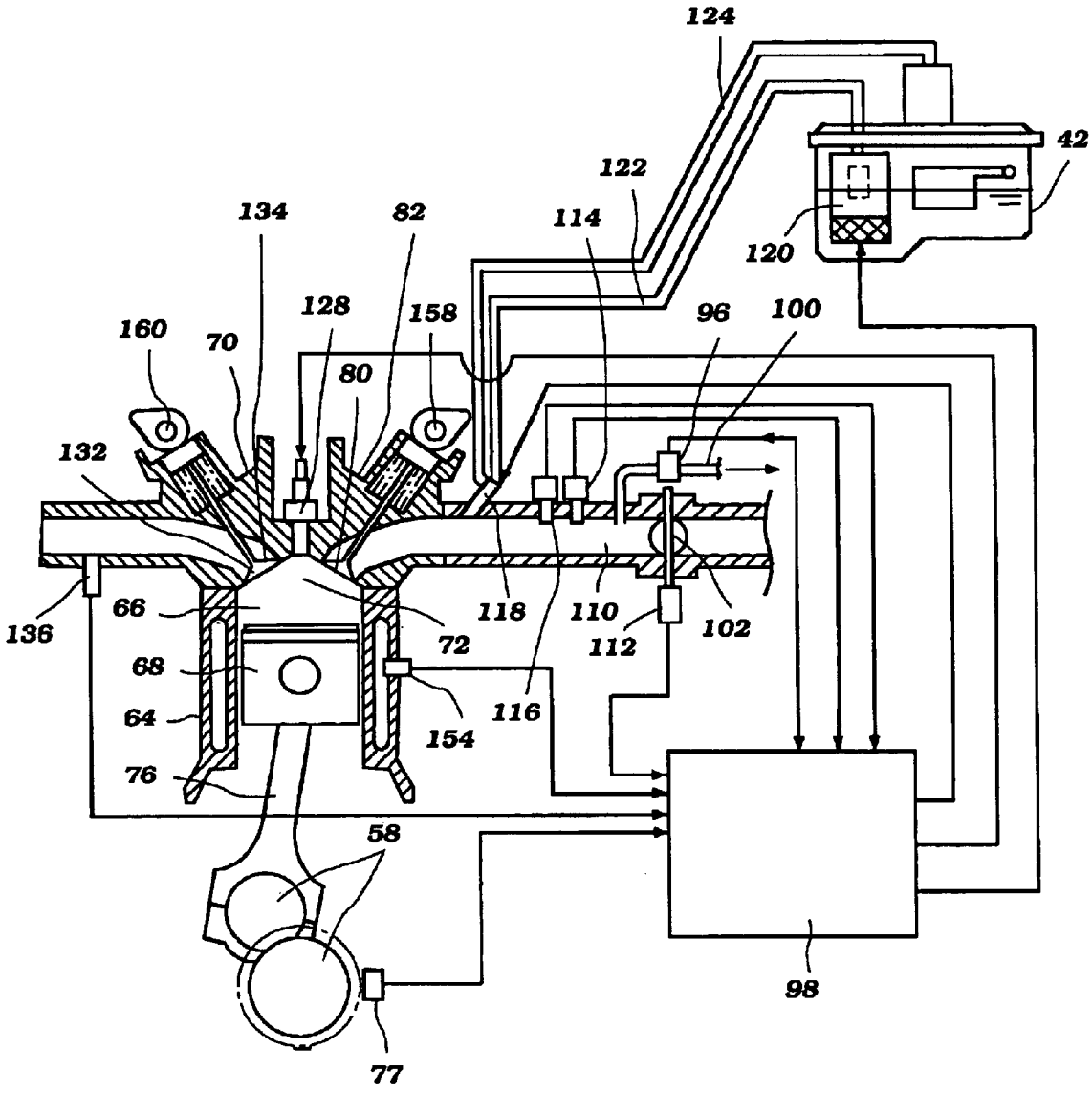
FIG. 6 is a schematic view showing the engine control system, including at least a portion of the engine in cross-section, an ECU, and a simplified fuel injection system.

With reference now to FIG. 5, in the illustrated arrangement, air is introduced into the plenum chamber 88 through a pair of airbox inlet ports 92 and a filter 94. With reference to FIG. 6, the illustrated air induction system preferably also includes an idle speed control device (ISC) 96 that may be controlled by an Electronic Control Unit (ECU) 98 discussed in greater detail below.

In one advantageous arrangement, the ECU 98 is a microcomputer that includes a micro-controller having a CPU, a timer, RAM, and ROM. Of course, other suitable configurations of the ECU also can be used. Preferably, the ECU 98 is configured with or capable of accessing various maps to control engine operation in a suitable manner.

In general, the ISC device 96 comprises an air passage 100 that bypasses a throttle valve assembly 102. Air flow through the air passage 100 of the ISC device 96 preferably is controlled with a suitable valve 104, which may be a needle valve or the like. In this manner, the air flow amount can be controlled in accordance with a suitable control routine, one of which is discussed below.

Throttle bodies 106 slant downwardly toward the port side relative to the center axis of the engine 12. Respective top ends 108 of the throttle bodies 106, in turn, open upwardly within the plenum chamber 88. Air in the plenum chamber 88 thus is drawn through the throttle bodies 106, through individual intake passages 110 and the intake ports 80 into the combustion chambers 72 when negative pressure is generated in the combustion chambers 72. The negative pressure is generated when the pistons 68 move toward the bottom dead center position from the top dead center position during the intake stroke.

Figure 7:
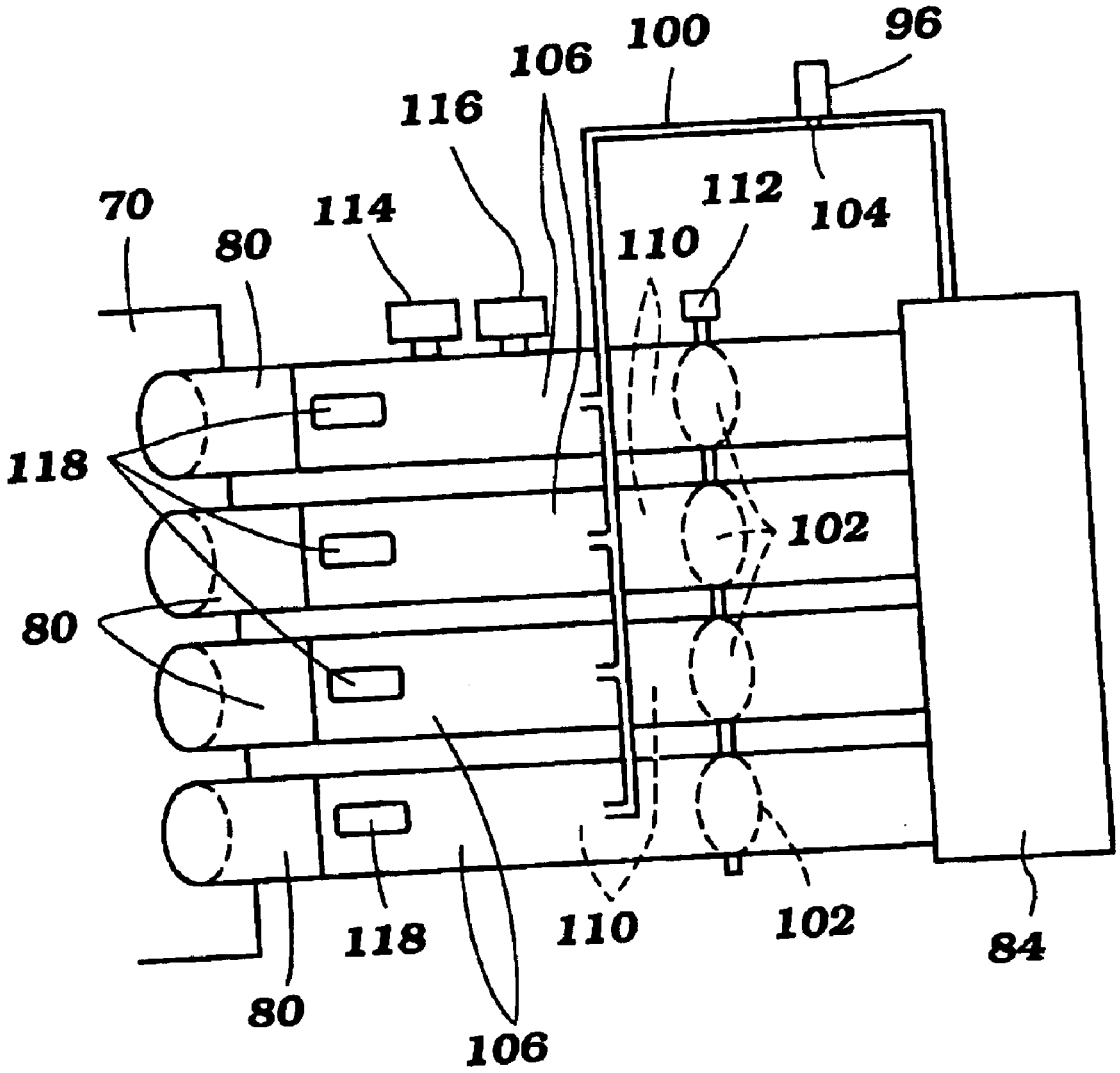
FIG. 7 is a cross-sectional view of the induction system of the engine. Portions of the intake manifold are illustrated partially in section.

With reference to FIG. 7, a throttle valve position sensor 112 preferably is arranged proximate the throttle valve assembly 102 in the illustrated arrangement. The sensor 112 preferably generates a signal that is representative of either absolute throttle position or movement of the throttle shaft. Thus, the signal from the throttle valve position sensor 112 corresponds generally to the engine load, as may be indicated by the degree of throttle opening. In some applications, a manifold pressure sensor 114 can also be provided to detect engine load. Additionally, an induction air temperature sensor 116 can be provided to detect induction air temperature. The signal from the sensors 112, 114, 116 can be sent to the ECU 98 via respective data lines. These signals, along with other signals, can be used to control various aspects of engine operation, such as, for example, but without limitation, fuel injection amount, fuel injection timing, ignition timing, ISC valve positioning and the like.

The engine 12 also includes a fuel injection system which preferably includes four fuel injectors 118, each having an injection nozzle exposed to the intake ports 80 so that injected fuel is directed toward the combustion chambers 72. Thus, in the illustrated arrangement, the engine 12 features port fuel injection. It is anticipated that various features, aspects and advantages of the present invention also can be used with direct or other types of indirect fuel injection systems.

With reference again to FIG. 6, fuel is drawn from the fuel tank 42 by a fuel pump 120, which is controlled by the ECU 98. The fuel is delivered to the fuel injectors 118 through a fuel delivery conduit 122. A fuel return conduit 124 also is provided between the fuel injectors 118 and the fuel tank 42. Excess fuel that is not injected by the fuel injector 118 returns to the fuel tank 42 through the conduit 124. The flow generated by the return of the unused fuel from the fuel injectors aids in cooling the fuel injectors.

In operation, a predetermined amount of fuel is sprayed into the intake ports 80 via the injection nozzles of the fuel injectors 118. The timing and duration of the fuel injection is dictated by the ECU 98 based upon any desired control strategy. In one presently preferred configuration, the amount of fuel injected is based upon the sensed throttle valve position and the sensed manifold pressure, depending on the state of engine operation. The fuel charge delivered by the fuel injectors 118 then enters the combustion chambers 72 with an air charge when the intake valves 82 open the intake ports 80.

The engine 12 further includes an ignition system. In the illustrated arrangement, four spark plugs 128 are fixed on the cylinder head member 70. The electrodes of the spark plugs 128 are exposed within the respective combustion chambers 72. The spark plugs 128 ignite an air/fuel charge just prior to, or during, each power stroke, preferably under the control of the ECU 98 to ignite the air/fuel charge therein.

The engine 12 further includes an exhaust system 130 to discharge burnt charges, i.e., exhaust gases, from the combustion chambers 72. In the illustrated arrangement, the exhaust system 130 includes four exhaust ports 132 that generally correspond to, and communicate with, the combustion chambers 72. The exhaust ports 132 preferably are defined in the cylinder head member 70. Exhaust valves 134 preferably are provided to selectively open and close the exhaust ports 132. A suitable exhaust cam arrangement, such as that described below, can be provided to operate the exhaust valves 134.

A combustion condition or oxygen sensor 136 preferably is provided to detect the in-cylinder combustion conditions by sensing the residual amount of oxygen in the combustion products at a point in time very close to when the exhaust port is opened. The signal from the oxygen sensor 136 preferably is delivered to the ECU 98. The oxygen sensor 136 can be disposed within the exhaust system at any suitable location. In the illustrated arrangement, the oxygen sensor 136 is disposed proximate the exhaust port 132 of a single cylinder. Of course, in some arrangements, the oxygen sensor can be positioned in a location further downstream; however, it is believed that more accurate readings result from positioning the oxygen sensor upstream of a merge location that combines the flow of several cylinders.

Figure 3:
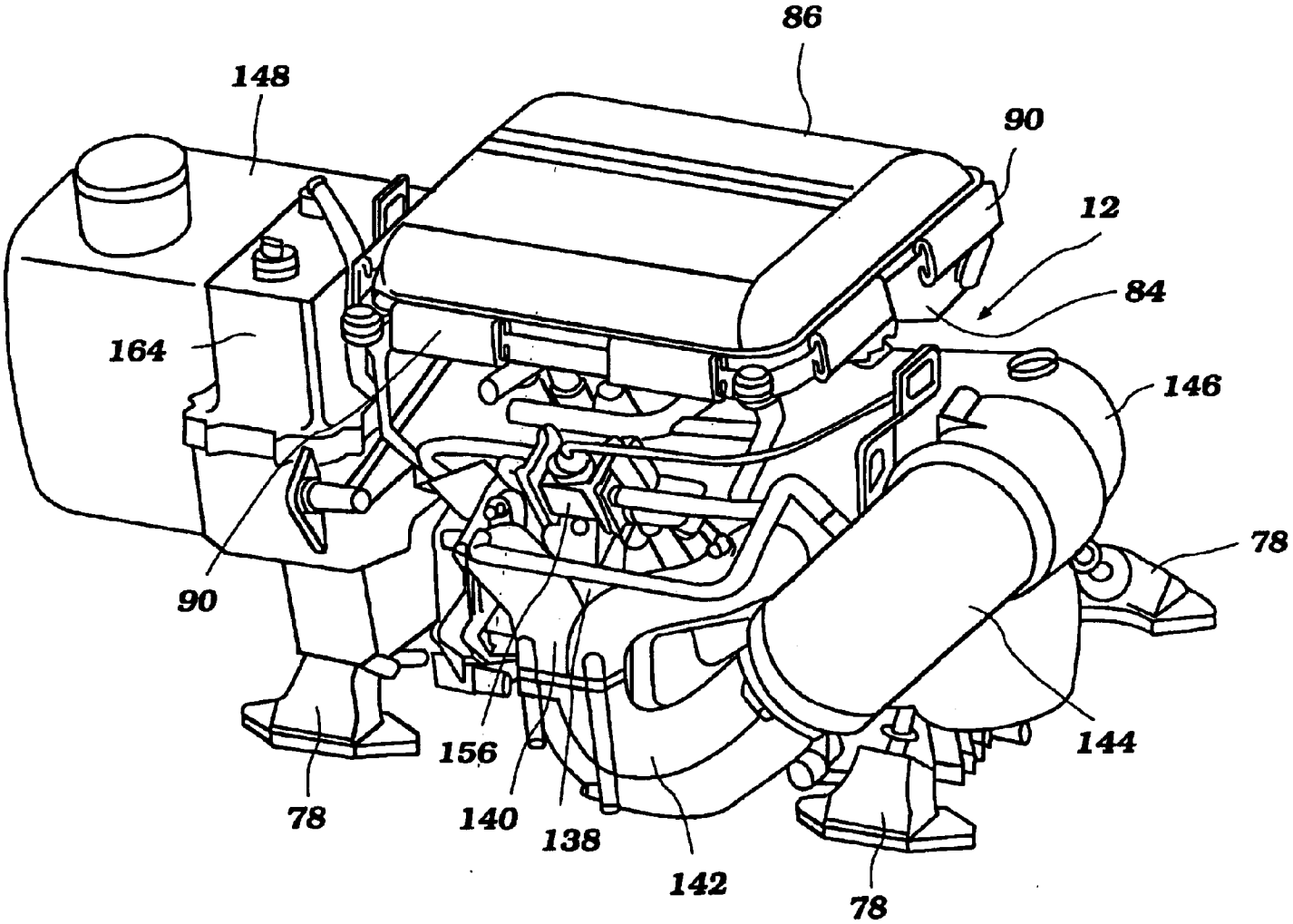
FIG. 3 is a front, starboard, and top perspective view of the engine removed from the watercraft illustrated in FIG. 1.

With reference now to FIG. 3, the illustrated exhaust system 130 preferably includes two small exhaust manifolds 138, 140 that each receive exhaust gases from a pair of exhaust ports 132 (i.e., a pair of cylinders). The respective downstream ends of the exhaust manifolds 138, 140 are coupled with a first unitary exhaust conduit 142. The first unitary conduit 142 is further coupled with a second unitary exhaust conduit 144. The second unitary conduit 144 is coupled with an exhaust pipe 146 at a location generally forward of the engine 12.

Figure 2:
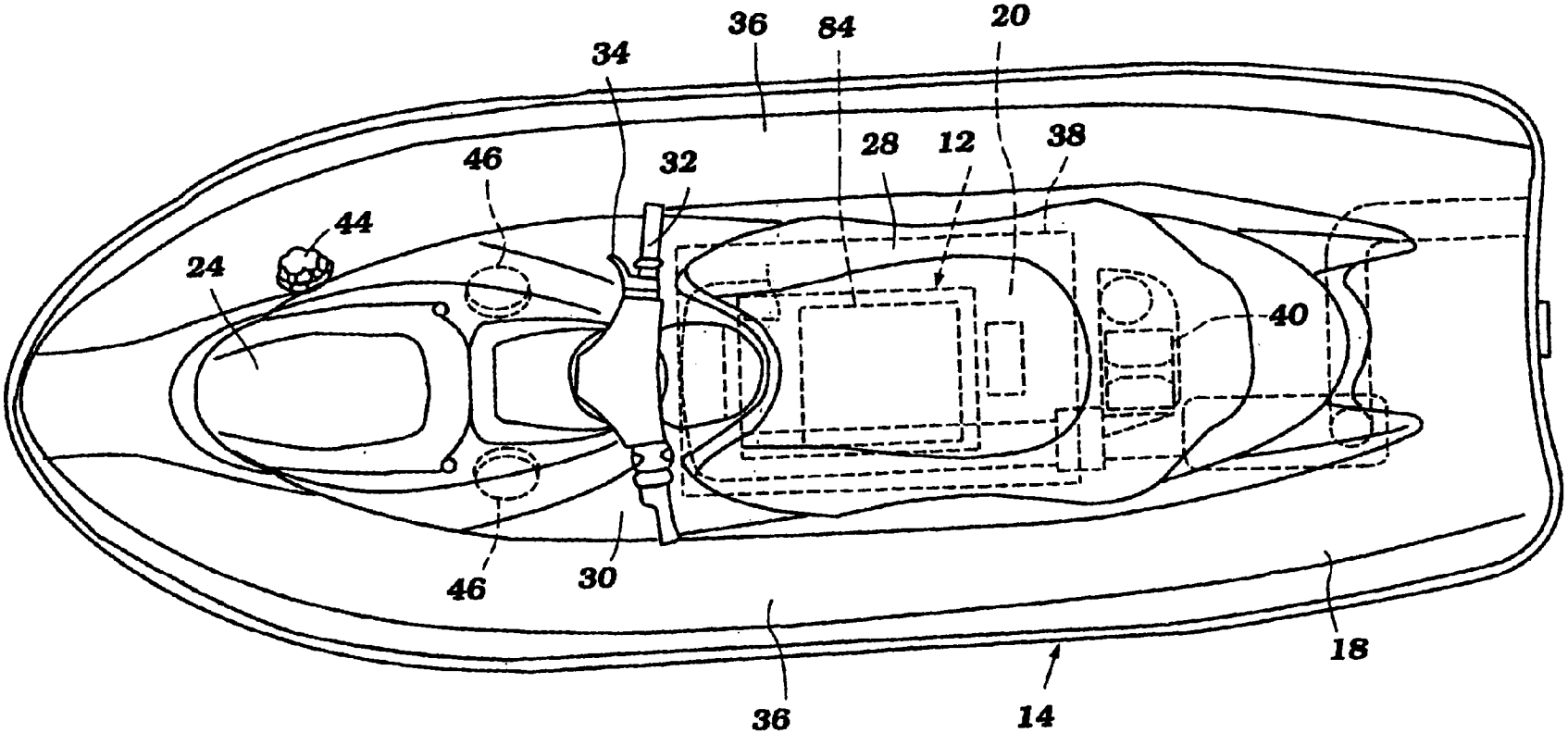
FIG. 2 is a top plan view of the watercraft of FIG. 1.

The exhaust pipe 146 extends rearwardly along a port side surface of the engine 12. The exhaust pipe 146 is connected to a water-lock 148 proximate a forward surface of the water-lock 148. With reference to FIG. 2, a discharge pipe 150 extends from a top surface of the water-lock 148. The discharge pipe 150 bends transversely across the center plane and rearwardly toward a stem of the watercraft. Preferably, the discharge pipe 150 opens at a stem of the lower hull section 16 in a submerged position. As is known, the water-lock 148 generally inhibits water in the discharge pipe 150 or the water-lock itself from entering the exhaust pipe 146.

The engine 12 further includes a cooling system configured to circulate coolant into thermal communication with at least one component within the watercraft 10. Preferably, the cooling system is an open-loop type of cooling system that circulates water drawn from the body of water in which the watercraft 10 is operating through thermal communication with heat generating components of the watercraft 10 and the engine 12. It is expected that other types of cooling systems can be used in some applications. For instance, in some applications, a closed-loop type liquid cooling system can be used to cool lubricant and other components.

The present cooling system preferably includes a water pump arranged to introduce water from the body of water surrounding the watercraft 10. The jet propulsion unit preferably is used as the water pump with a portion of the water pressurized by the impeller being drawn off for use in the cooling system, as is generally known in the art. Preferably, water jackets 152 can be provided around portions of the cylinder block 64 and the cylinder head member 70 (see FIG. 6).

In some applications, the exhaust system 130 is comprised of a number of double-walled components such that coolant can flow between the two walls (i.e., the inner and outer wall) while the exhaust gases flow within a lumen defined by the inner wall. Such constructions are well known.

An engine coolant temperature sensor 154 preferably is positioned to sense the temperature of the coolant circulating through the engine. Of course, the sensor 154 could be used to detect the temperature in other regions of the cooling system; however, by sensing the temperature proximate the cylinders of the engine, the temperature of the combustion chamber and the closely positioned portions of the induction system is more accurately reflected.

With reference again to FIG. 3, the engine 12 preferably includes a secondary air supply system that supplies air from the air induction system to the exhaust system 130. Hydrocarbon (HC) and carbon monoxide (CO) components of the exhaust gases can be removed by an oxidation reaction with oxygen ($O_2$) that is supplied to the exhaust system 130 from the air induction system. In one arrangement of the secondary air supply system, a secondary air supply device 156 is disposed next to the cylinder head member 70 on the starboard side. The air supply device 156 defines a generally closed cavity and contains a control valve in the illustrated arrangement. Air supplied from the air supply device 156 passes directly to the exhaust system 130 when the engine 12 is operating in a relatively high speed range and/or under a relatively high load condition because greater amounts of hydrocarbon (HC) and carbon monoxide (CO) are more likely to be present in the exhaust gases under such a condition.

With reference to FIGS. 5 and 6, the engine 12 preferably has a valve cam mechanism for actuating the intake and exhaust valves 82, 134. In the illustrated embodiment, a double overhead camshaft drive is employed. That is, an intake camshaft 158 actuates the intake valves 82 and an exhaust camshaft 160 separately actuates the exhaust valves 134. The intake camshaft 158 extends generally horizontally over the intake valves 82 from fore to aft, and the exhaust camshaft 160 extends generally horizontally over the exhaust valves 134 also from fore to aft.

Both the intake and exhaust camshafts 158, 160 are journaled in the cylinder head member 70 in any suitable manner. A cylinder head cover member 162 extends over the camshafts 158, 160, and is affixed to the cylinder head member 70 to define a camshaft chamber. The secondary air supply device 156 is preferably affixed to the cylinder head cover member 162. Additionally, the air supply device 156 is desirably disposed between the intake air box and the engine 12.

The intake camshaft 158 has cam lobes each associated with the respective intake valves 82, and the exhaust camshaft 160 also has cam lobes associated with respective exhaust valves 134. The intake and exhaust valves 82, 134 normally close the intake and exhaust ports 80, 132 by a biasing force of springs. When the intake and exhaust camshafts 158, 160 rotate, the cam lobes push the respective valves 82, 134 to open the respective ports 80, 132 by overcoming the biasing force of the spring. Air enters the combustion chambers 72 when the intake valves 82 open. In the same manner, the exhaust gases exit from the combustion chambers 72 when the exhaust valves 134 open.

The crankshaft 58 preferably drives the intake and exhaust camshafts 158, 160. The respective camshafts 158, 160 have driven sprockets affixed to ends thereof while the crankshaft 58 has a drive sprocket. Each driven sprocket has a diameter that is twice as large as a diameter of the drive sprocket. A timing chain or belt is wound around the drive and driven sprockets. When the crankshaft 58 rotates, the drive sprocket drives the driven sprockets via the timing chain, and thus the intake and exhaust camshafts 158, 160 also rotate.

Figure 4:
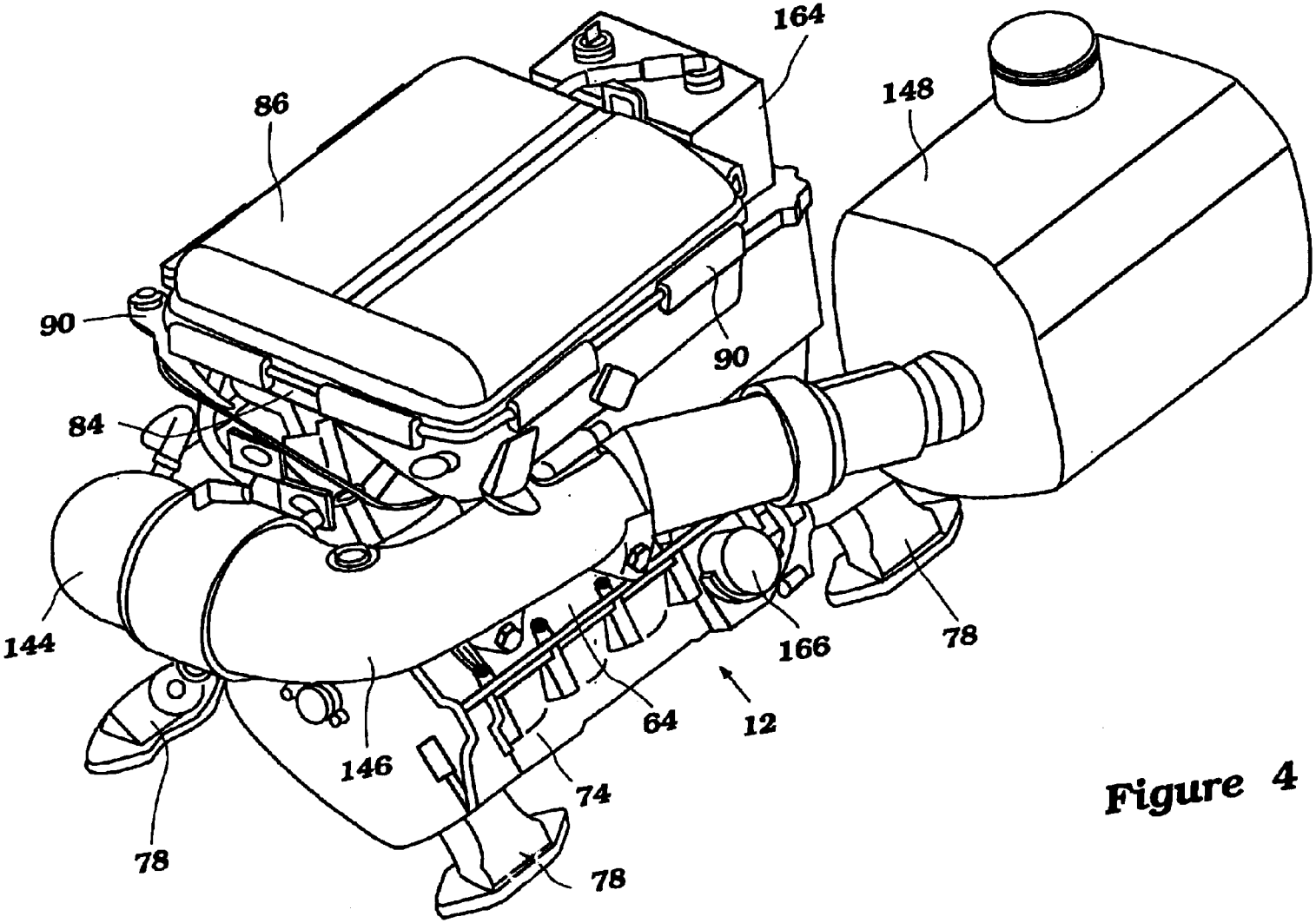
FIG. 4 is a front, port, and top perspective view of the engine removed from the watercraft illustrated in FIG. 1.

The engine 12 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 164, as illustrated in FIGS. 3 and 4.

An oil delivery pump is provided within a circulation loop to deliver the oil in the reservoir 164 through an oil filter 166 to the engine portions that are to be lubricated, for example, but without limitation, the pistons 68 and the crankshaft bearings (not shown). The crankshaft 58 or one of the camshafts 158,160 preferably drives the delivery and return pumps.

In order to determine appropriate engine operation control scenarios, the ECU 98 preferably uses control maps and/or indices stored within the ECU 98 in combination with data collected from various input sensors. The ECU's various input sensors can include, but are not limited to, the throttle position sensor 112, the manifold pressure sensor 114, the engine coolant temperature sensor 154, the oxygen ($O_2$) sensor 136, and a crankshaft speed sensor 77.

It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

During engine operation, ambient air enters the internal cavity 20 defined in the hull 14 through the air ducts 44. As seen in FIGS. 5, 6, and 7, the air is then introduced into the plenum chamber 88 defined by the intake box 84 through the air inlet ports 92 and drawn into the throttle bodies 106. The air filter element 94, which preferably comprises a water-repellent element and an oil resistant element, filters the air. The majority of the air in the plenum chamber 88 is supplied to the combustion chambers 72. The throttle valves 102 in the throttle bodies 106 regulate an amount of the air permitted to pass to the combustion chambers 72. The opening angles of the throttle valves 102, and thus, the airflow across the throttle valves 102, can be controlled by the rider with the throttle lever 34. The air flows into the combustion chambers 72 when the intake valves 82 open. At the same time, the fuel injectors 118 spray fuel into the intake ports 80 under the control of ECU 98. Air/fuel charges are thus formed and delivered to the combustion chambers 72.

The air/fuel charges are fired by the spark plugs 128 under the control of the ECU 98. The burnt charges, i.e., exhaust gases, are discharged to the body of water surrounding the watercraft 10 through the exhaust system 130. A relatively small amount of the air in the plenum chamber 88 is supplied to the exhaust system 130 so as to aid in further combustion of any unburned fuel remaining in the exhaust gases.

The combustion of the air/fuel charges causes the pistons 68 to reciprocate and thus causes the crankshaft 58 to rotate. The crankshaft 58 drives the impeller shaft 56 and the impeller rotates in the hull tunnel 50. Water is thus drawn into the tunnel 50 through the inlet port 52 and then is discharged rearward through the steering nozzle 62. The rider steers the nozzle 62 by the steering handle bar 32. The watercraft 10 thus moves as the rider desires.

Figure 8:
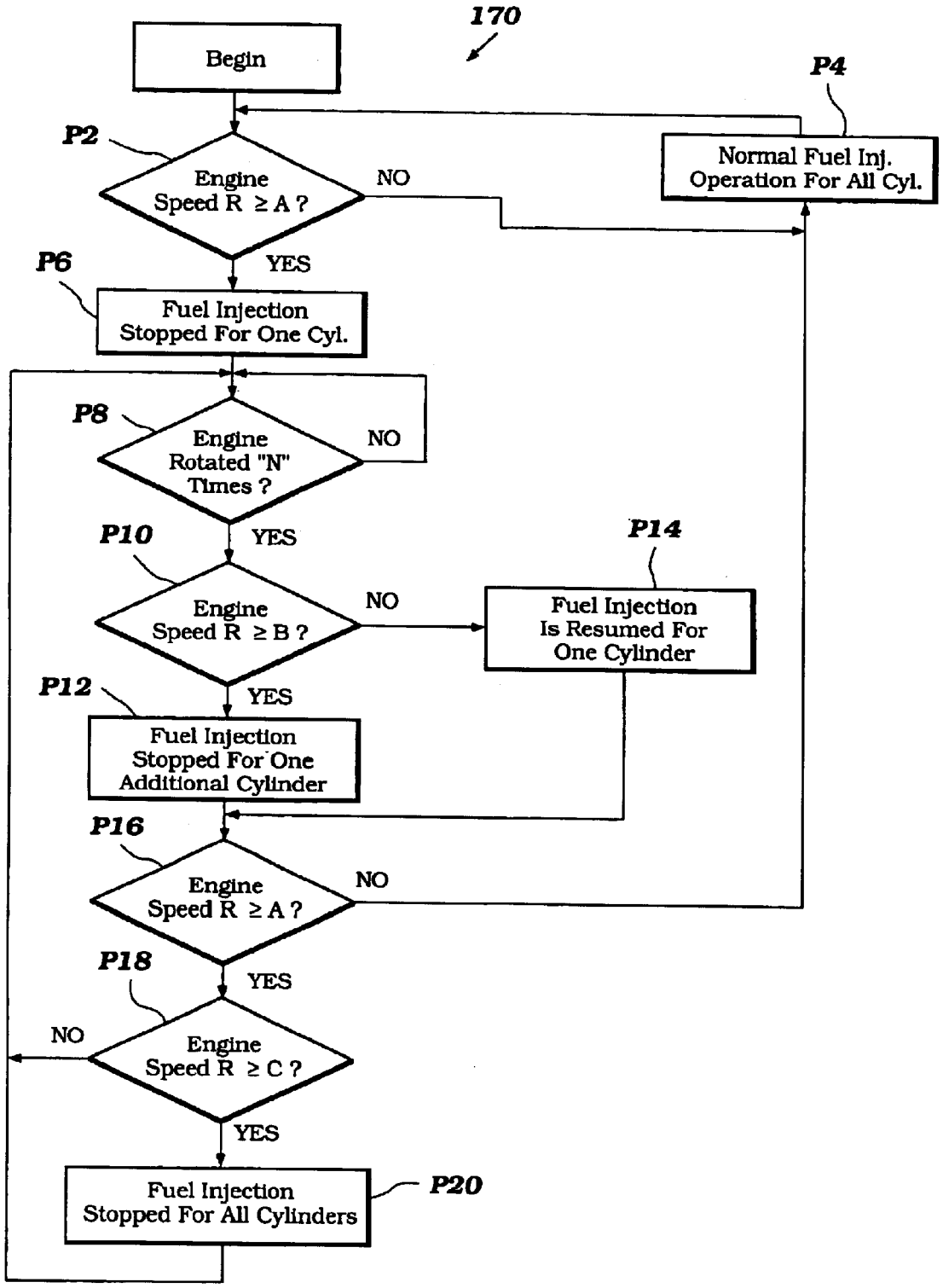
FIG. 8 is a block diagram showing a control routine arranged and configured in accordance with certain features, aspects and advantages of the present invention.

With reference to FIG. 8, a control arrangement is shown that is arranged and configured in accordance with certain features, aspects and advantages of the present invention. The control routine 170 is configured to control operation of the fuel injection based on engine speed to prevent over-revving engine damage. As shown in FIG. 8, the control routine begins and moves to a first decision block P2. In the illustrated embodiment, the routine 170 can start as soon as a rider attempts to start the engine 12, for example as soon as the start button is activated. However, it is to be understood that the routine 170 can start at any time.

In decision block P2, the engine speed R is compared to a predetermined initial engine speed A. Preferably, the predetermined initial engine speed A is an engine speed that is higher than an engine speed that corresponds to a steady-state full throttle/top speed operation where the intake duct of the jet propulsion unit is completely submerged. If the engine speed R is determined to be not greater than or equal to speed A, the program moves to the operation block P4.

In the operation block P4, normal fuel injection operation is established for all cylinders of engine 12. Preferably, the control routine 170 returns to the beginning and repeats as long as the engine is running.

If however, at the operation block P2, the sensed engine speed R is not greater than or equal to A, the control routine 170 moves to operation block P6 where the fuel injection is stopped for a single cylinder, thereby disabling that cylinder. Stopping fuel injection for a single cylinder reduces the total power output of the engine 12 by a first degree. In other words, the power output of the engine is reduced to a first state of reduced power output. Under certain conditions, such a reduction in power output will result in a reduction in engine speed. However, under other conditions, discussed in greater detail below, the engine speed may not fall.

After the operation block P6, the control routine 170 then proceeds to a decision block P8 where it is determined if the engine has rotated N times (N corresponding to the number of revolutions needed to complete a combustion cycle, for a four cycle, N=2). If the engine has not rotated N times then the control routine 170 returns to P8 until the number of engine revolutions N is achieved.

If however, at the decision block P8, the engine has rotated N times, the control routine 170 moves to decision block P10 where it determines if the engine speed R is greater than or equal to B. The second predetermined engine speed B is an engine speed that is higher than engine speed A.

If, at decision block P10, it is determined that the engine speed R is greater than or equal to the predetermined engine speed B, the control routine 170 moves to operation block P12 where the fuel injection is stopped for an additional cylinder. Stopping the fuel injection for an additional cylinder will further reduce the total power output of the engine 12, by a second degree. In other words, the power output of the engine is reduced to a second state of reduced power.

Under certain conditions, such a further reduction in power output can cause the engine speed R to fall. However, under other conditions, discussed in greater detail below, the engine speed R may not fall. The control routine 170 then moves to decision block P16.

If however, in decision block P10, it is determined that the engine speed R is not greater than or equal to a second predetermined engine speed B, the control routine 170 moves to operation block P14.

At the operation block P14, the control routine 170 resumes fuel injection to the cylinder disabled at the operation block P6. Thus, the power output of the engine 12 is increased by a degree. In other words, the power output of the engine 12 is restored or increased by the first degree, back to the normal power output. After the operation block P14, the control routine 170 moves to the decision block P16.

In decision block P16, the control routine 170 again determines if an engine speed R is greater than or equal to the first predetermined engine speed A. If the engine speed R is not greater than or equal to the first predetermined engine speed A, the control routine 170 moves to operation block P4 where normal fuel injection operation is resumed for all cylinders.

If however, in decision block P16, the engine speed R is greater than or equal to the first predetermined engine speed A, the control routine 170 moves to decision block P18 where the engine speed R is compared to a third predetermined engine speed C, which is higher than the first and second predetermined engine speeds.

If in the decision block P18 the engine speed R is found to be greater or equal to the third predetermined engine speed C the control routine 170 moves to operation block P20 where the fuel injection is stopped for all cylinders. Stopping the fuel injection for all cylinders lowers the engine speed under any condition the watercraft 10 is likely to experience in operation.

If however, in decision block P18 the engine speed R is not greater than or equal to the third predetermined engine speed, the control routine 170 moves to decision block P8 and repeats.

Figure 9:
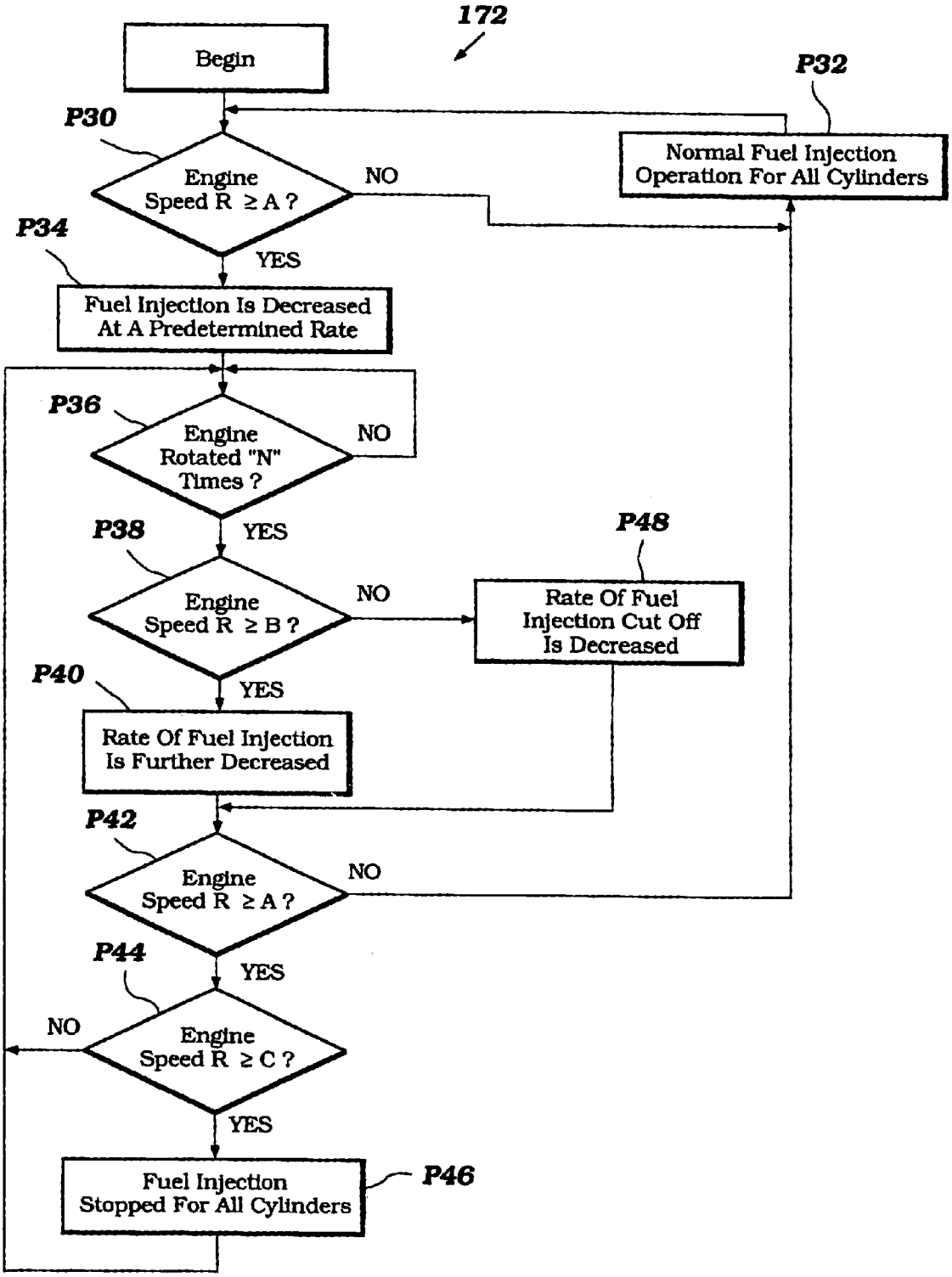
FIG. 9 is a block diagram showing another control routine arranged and configured in accordance with certain features, aspects and advantages of the present invention.

With reference now to FIG. 9, a modification of the control routine 170 is shown therein and referred to by the reference numeral 172. The control routine 172 is configured to control operation of the fuel injection based on engine speed. As shown in FIG. 9, the control routine begins and moves to a first decision block P30. In the illustrated embodiment, the routine 172 can start as soon as a rider attempts to start the engine 12, for example as soon as the start button is activated. However, it is to be understood that the routine 172 can start at any time.

In decision block P30, the engine speed R is compared to the first predetermined engine speed A. If the engine speed R is not greater than or equal to speed A, the program moves to the operation block P32.

In the operation block P32, normal fuel injection operation is continued or reestablished for all cylinders of engine 12. Preferably, the control routine 172 returns to the beginning and repeats as long as the engine is running.

If however in the decision block P30, the sensed engine speed R is not greater than or equal to A, the control routine 172 moves to operation block P34 where the fuel injection for all cylinders is decreased at a predetermined rate. For example, the control routine 172 can decrease the fuel injection to all of the cylinders by 20%. i.e., for five fuel injection cycles, one is skipped. This method of reducing fuel injection is explained below in greater detail with reference to FIGS. 11*a* and 11*b*. Under certain conditions, reducing fuel injection as such will cause the engine speed R to fall. However, under other conditions, discussed below in greater detail, the engine speed R may not fall. After the operation block P34, the control routine 170 moves to a decision block P36.

At the decision block P36 it is determined if the engine has rotated N times (N corresponding to the number of revolutions needed to complete a combustion cycle, e.g. for a four cycle engine, N=2). If the engine has not rotated N times then the control routine 172 returns to P36 until the number of engine revolutions N is achieved.

If however, the engine has rotated N times, the control routine 172 moves to decision block P38 where it determines if the engine speed R is greater than or equal to the second predetermined engine speed B. If it is determined that the engine speed R is greater than or equal to the predetermined engine speed-B, the control routine 172 moves to an operation block P40.

At the operation block P40, the fuel injection is further decreased for all cylinders by a predetermined rate. For example, the control routine 172 can further decrease the fuel injection for all of the cylinders by an additional 20%, resulting in a 40% reduction in fuel injection relative to the normal fuel injection scenario. After the operation block P40, the control routine 172 then moves to a decision block P42.

If however, in decision block P38 it is determined that the engine speed R is not greater than or equal to a second predetermined engine speed B, the control routine 172 moves to operation block P48, where the rate of fuel injection cutoff is decreased. For example, if the fuel injection had been decreased by 20% in operation block P34, fuel injection can be increased by 20%. The control routine then moves to decision block P42.

In the decision block P42, the control routine 172 again determines if an engine speed R is greater than or equal to the first predetermined engine speed A. In decision block P42, if the engine speed R is not greater than or equal to the first predetermined engine speed A, the control routine 172 moves to operation block P32 where normal fuel injection operation is established for all cylinders.

If however, in decision block P42, the engine speed R is greater than or equal to the first predetermined engine speed A, the control routine 172 moves to decision block P44 where the engine speed R is compared to the third predetermined engine speed C.

If, in the decision block P44, the engine speed R is found to be greater or equal to the third predetermined engine speed C the control routine 172 moves to operation block P46 where the fuel injection is stopped for all cylinders. Stopping the fuel injection for all cylinders lowers the engine speed in any condition in which the watercraft 10 is likely to be operated.

If however, in decision block P44 the engine speed R is not greater than or equal to the third predetermined engine speed threshold the control routine moves to decision block P36 and continues to repeat the control routine steps.

It is to be noted that the control systems described above may be in the form of a hard-wired feedback control circuit in some configurations. Alternatively, the control systems may be constructed of a dedicated processor and memory for storing a computer program configured to perform the steps described above in the context of the flowcharts.

Additionally, the control systems may be constructed of a general purpose computer having a general purpose processor and memory for storing the computer program for performing the routines. Preferably, however, the control systems are incorporated into the ECU 110, in any of the above-mentioned forms.

Figure 10A:
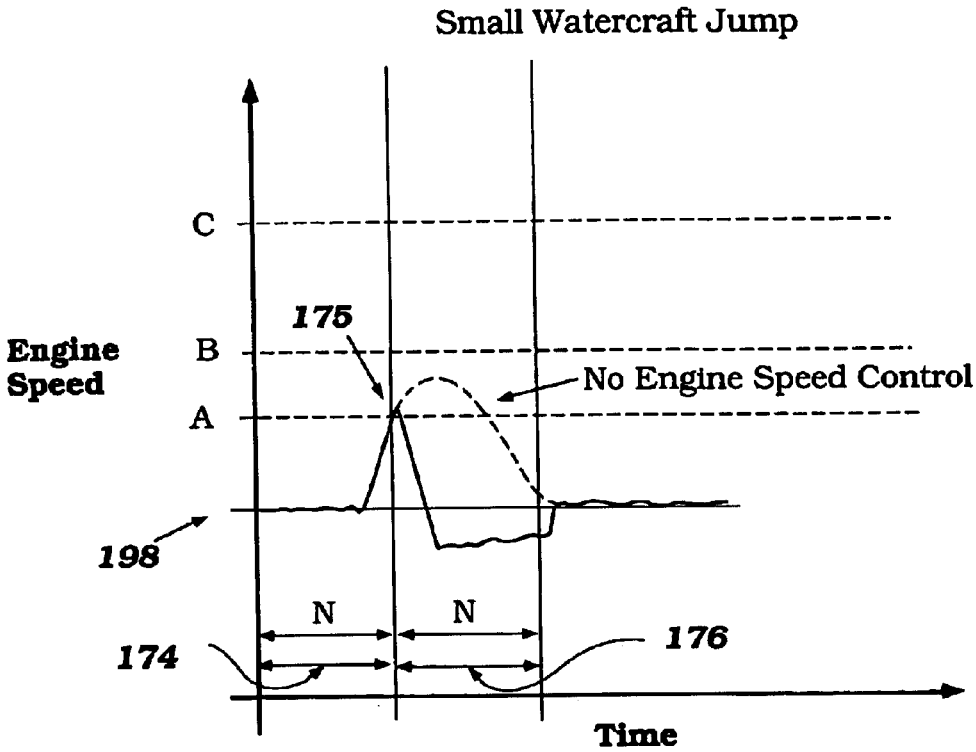
FIG. 10*a* is a diagram of a graph illustrating engine speed characteristics during a small jump out of the water of a watercraft.
Figure 10B:
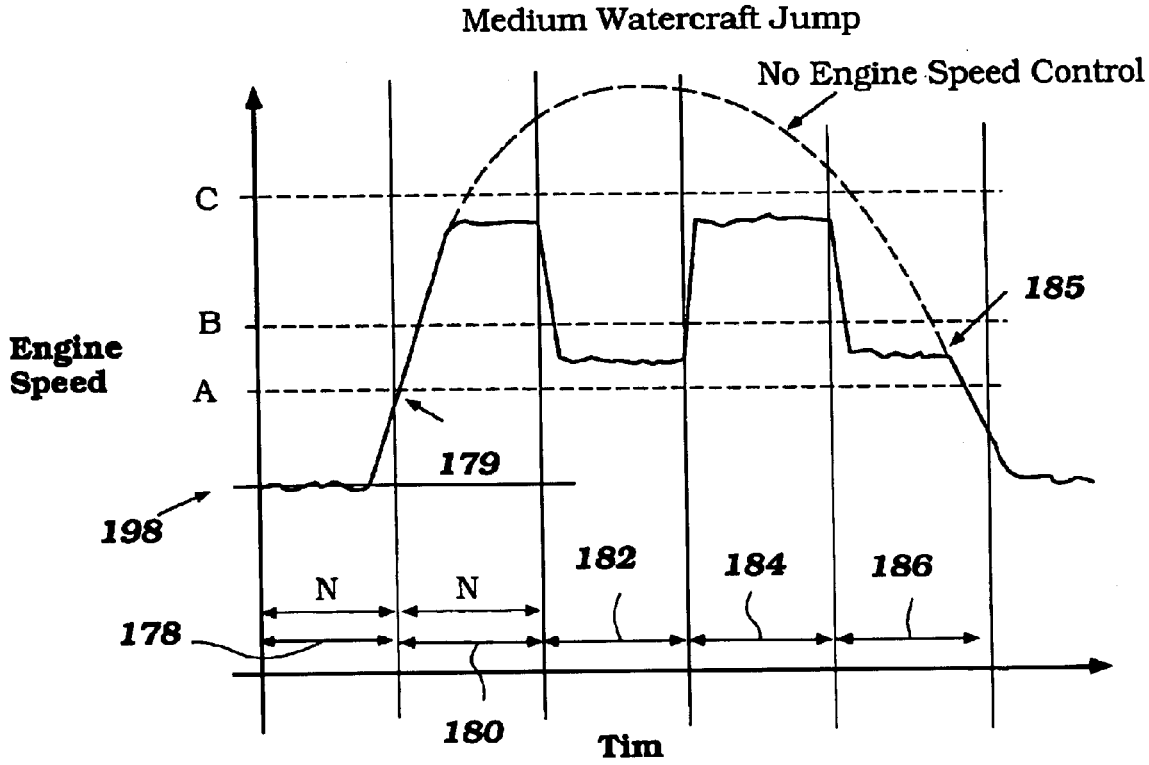
FIG. 10*b* is a diagram of a graph illustrating engine speed characteristics during a medium jump out of the water of a watercraft.
Figure 10C:
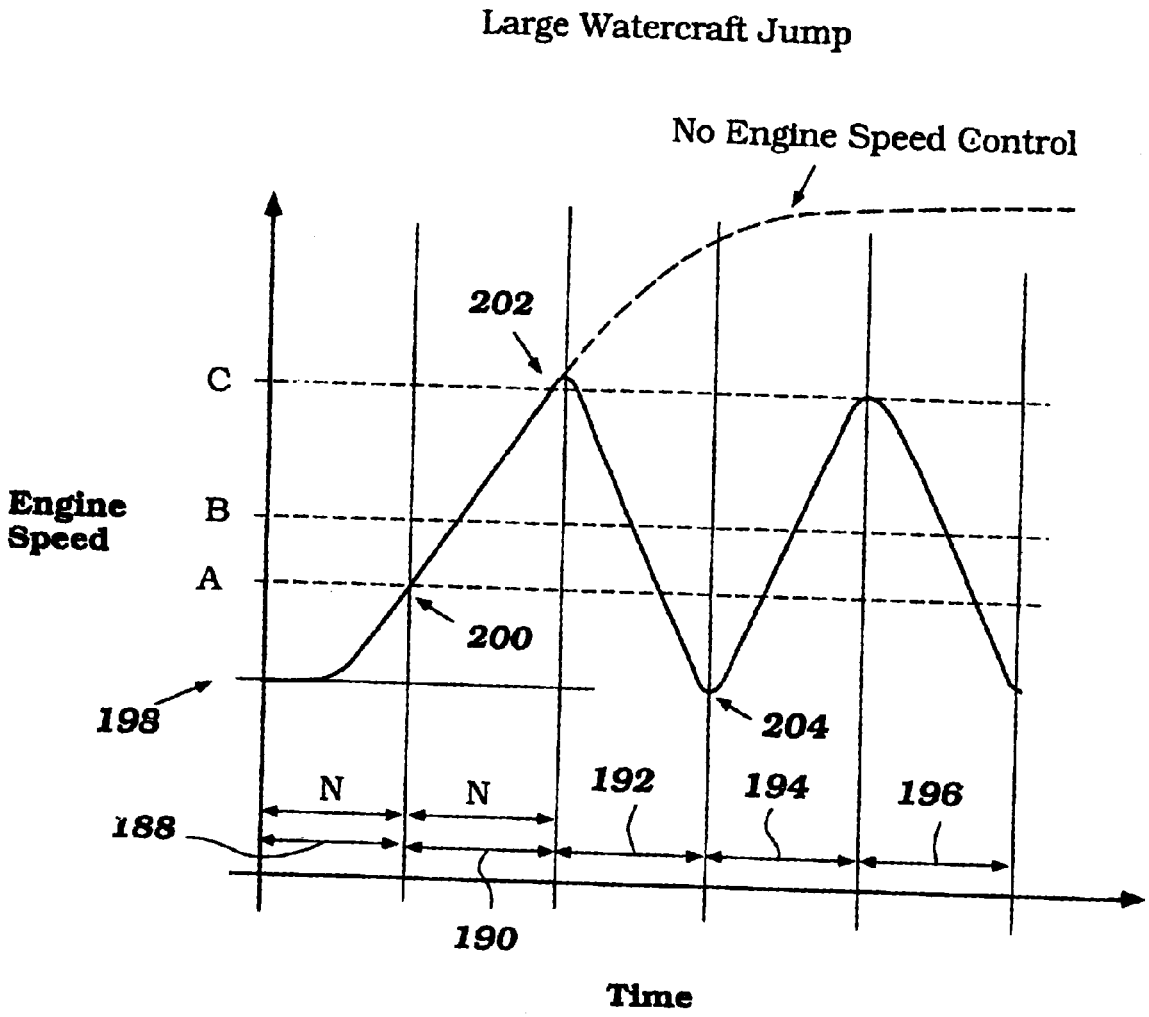
FIG. 10*c* is a diagram of a graph illustrating engine speed characteristics during a large jump out of the water of a watercraft.

With reference to FIGS. 10*a*, 10*b*, and 10*c*, graphs illustrating engine speed characteristics during various operational conditions of the watercraft 10. In particular, FIGS. 10*a*, 10*b*, and 10*c* illustrate a relationship between engine speed (vertical axis) and time (horizontal axis) when the watercraft jumps out of the water sufficiently to cause air to be drawn into the jet pump. In each figure, a solid line represents the behavior of the engine 12 during a small jump (FIG. 10*a*), a medium jump (FIG. 10*b*), and a large jump (FIG. 10*c*). Additionally, each of these figures includes a dashed line representing the theoretical behavior of a watercraft engine with no rev-limiter.

In the FIGS. 10*a*, 10*b*, and 10*c*, a steady state, constant, full throttle engine speed 198 is illustrated. At this steady state engine speed the jet pump unit 48 is experiencing a consistent load. However this engine speed 198 is not the highest allowable engine speed. At an engine speed range above the steady state engine speed 198, the present invention is designed to limit higher engine speeds in proportion to a magnitude in reduction of load, such as that caused when the watercraft jumps partially or completely out of the water.

Three predetermined engine speeds, A, B, and C are used to as reference so as to create a proportional rev-limiting response in order to maintain a smooth ride. The first predetermined engine speed A represents an engine speed that is slightly higher than the optimal engine speed 198. At the detection of the first predetermined engine speed A the control system starts to limit the engine speed. A second predetermined engine speed B is slightly above the first predetermined engine speed A. A third predetermined engine speed C represents an engine speed that can be too high for the engine to operate properly. The predetermined engine speed C corresponds to an engine speed in which the control system can rapidly lower the engine speed to an engine speed where the engine operates more efficiently.

With reference to FIG. 10*a* and the control routines 170 and 172, the engine speed of the watercraft 10 during a small jump with reference to time is shown. In time increment 174, an engine speed increase is shown approaching the first predetermined engine speed A. With reference to P2 and P30, when the engine speed reaches the first predetermined engine speed A at a point 175, the power output of the engine is lowered. Under this condition, where only a small amount of air enter the jet pump unit 48, reducing the power output of the engine 12 to the first reduced output state is sufficient to cause the engine speed to drop below the speed A. In time increment 176, a controlled engine speed decrease can by seen where the engine speed is initially brought down for a period of time N, which corresponds to the operation performed in the operation block P8, and then resumes to optimal operating speed.

With reference to FIG. 10*b* and the control routines 170 and 172, the engine speed of the watercraft during a medium jump with reference to time is shown. In time increment 178, an initial engine speed increase can be seen. As seen in time increment 180, this speed increase reaches above the first predetermined speed A at point 179. Thus, as dictated by operation block P6 and P34, the power output of the engine 12 is initially reduced. However, because of the size of this jump, and the accompanying drop in load on the engine, the engine speed does not stop increasing until it reaches a speed between the predetermined speeds B and C.

At the end of the time period 180, after the engine has rotated N times, it is determined that the engine speed is above speed B. Thus, as dictated by the operation blocks P12 and P40, the power output of the engine 12 is further reduced, i.e., reduced to a second state of reduced power, such as for example but without limitation, two cylinders disabled or fuel injection reduced by 40%. As represented in FIG. 10*b*, this power reduction is sufficient to cause the engine speed to fall. As illustrated at the beginning of the time period 182, the engine speed falls to a speed between the speeds A and B.

At the end of the time period 182, the routines 170, 172 then return to the decision blocks P10 and P38 respectively. Because the engine speed is below speed B, power output is increased by a degree. In this case, the power output is restored to the first state of reduced power output, for example but without limitation, only one cylinder disabled or fuel injection reduced by 20%. Thus, due to the magnitude of this jump, the engine speed rises to speed between the speeds B and C.

As the routines 170, 172 repeat, the engine 12 is allowed to operate at a speed above the speed A. Thus, as the jet pump unit is re-loaded, the engine speed does not drop abruptly. As noted above, abrupt drops in engine speed can make the operator and passengers uncomfortable.

FIG. 10*c* illustrates the behavior of the control routines 170 and 172 and their affect on the engine speed of the watercraft during a large jump. During time increments 188, 190, 192, 194, 196, the engine speed fluctuates due to a prolonged lack of engine load by the absence of water in the jet pump unit 48.

For example, as the engine speed rises above speed A, at the end of time period 188 (point 200), the control routines 170, 172 reduce power output at operation blocks P6 and P34, respectively. However, due to the magnitude of this jump, the engine speed does not fall. By the time the engine speed is sensed again at decision blocks P10 and P38, after the time delay produced by decision blocks P8 and P36 (the end of time period 190), the engine speed has already exceeded speed C (point 202). Thus, the routines quickly reach operation blocks P20 and P46, cutting off all power.

Because the engine speed is considerable, the engine continues to rotate as it slows. As the routines reach decision block P16 and 942, respectively, the engine speed falls to a speed below speed A (point 204). Thus, normal fuel injection, and thus, full power output are restored (operation blocks P4, P32). However, because the jet pump unit 46 is not loaded, the cycle repeats until the jet pump unit 46 is re-loaded.

Figure 11A:
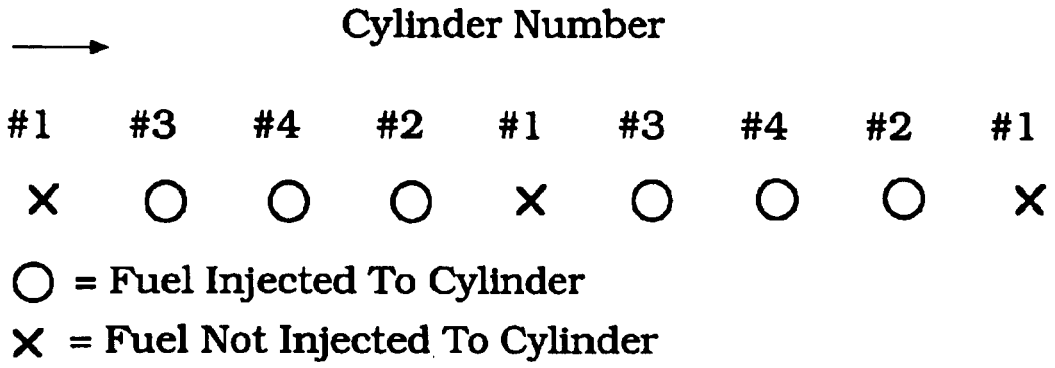
FIG. 11*a* is a diagram illustrating a procedure for a fuel injection cut-off sequence arranged and configured in accordance with certain features, aspects and advantages of the present invention.
Figure 11B:
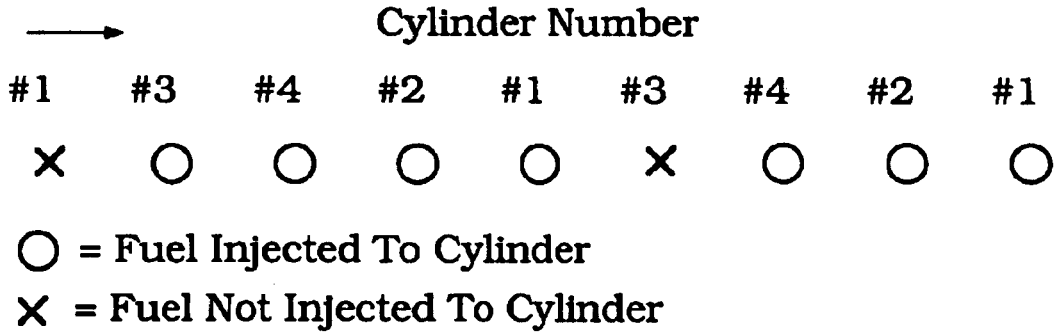
FIG. 11*b* is a diagram illustrating another procedure for a fuel injection cutoff sequence arranged and configured in accordance with certain features, aspects and advantages of the present invention.

With reference to FIGS. 11*a* and 11*b*, procedures for a fuel injection cut-off sequence are shown. Both procedures represent ways to regulate a fuel injection cut-off sequence, which preserves a smooth-feeling operation for the watercraft operator. As shown in FIG. 11*a*, a fuel injection sequence follows from left to right. Numbers represent which cylinder into which the fuel is being injected. A zero indicates that a normal fuel injection cycle is performed for the corresponding cylinder, and an X represents fuel injection cut-off for that cylinder. FIG. 11*a* shows a fuel injection cutoff sequence where the same cylinder is being repeatedly deprived of fuel. As such, FIG. 11*a* corresponds to fuel injection being cut-off for one cylinder of the engine 12.

Such a reduction of fuel injection can also be expressed as a percentage. For example, when fuel injection to one cylinder is stopped in a four cylinder engine, one fuel injection cycle is skipped for every four fuel injection cycles of the normal mode. Thus, in the scenario illustrated in FIG. 11*a*, fuel injection has been reduced by 25%.

As shown in FIG. 11*b*, a fuel injection sequence again follows from left to right. Numbers represent which cylinder into which the fuel is being injected. A zero indicates that a normal fuel injection cycle is performed for the corresponding cylinder, and an X represents fuel injection cut-off for that cylinder. FIG. 11*b* shows a fuel injection cut-off sequence where each cylinder is being sequentially deprived of fuel. As such, FIG. 11*b* corresponds to fuel injection being cut-off for one cylinder per fuel injection cycle of the engine 12 in an alternating sequence.

Such a reduction of fuel injection can also be expressed as a percentage. For example, when fuel injection to one cylinder per fuel injection cycle is stopped in an alternating sequence in a four cylinder engine, one fuel injection cycle is skipped for every five fuel injection cycles of the normal mode. Thus, in the scenario illustrated in FIG. 11*b*, fuel injection has been reduced by 20%. An alternating sequential fuel injection cut off prevents damage associated with repeated cylinder disablement.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. Moreover, not all of the features, aspects and advantages are necessarily required to practice the present invention. Accordingly, the scope of the present invention is intended to be defined only by the claims that follow.

What is claimed is:

1. A method of controlling a multi-cylinder marine engine associated with a watercraft, the method comprising injecting fuel into the engine for combustion therein, sensing a first engine speed, comparing the first sensed engine speed with a first predetermined speed, stopping fuel injection to a first cylinder if the first sensed engine speed is greater than the first predetermined speed, sensing a second engine speed after the engine has completed a predetermined number of rotations, restoring fuel injection to the first cylinder if the second sensed engine speed is less than a second predetermined speed that is greater than the first predetermined engine speed.

2. A method of controlling a marine engine associated with a watercraft, the method comprising sensing a first engine speed, comparing the first sensed engine speed with a first predetermined speed, reducing fuel supply to the engine by a first delivery amount if the first sensed engine speed is above the first predetermined engine speed, sensing a second engine speed after reducing fuel delivery by a first fuel amount, restoring fuel delivery by the first fuel amount if the second sensed engine speed is below a second predetermined engine speed that is greater than the first predetermined engine speed.

3. The method of claim 2 additionally comprising further reducing fuel delivery by a second fuel amount if the second sensed engine speed is greater than or equal to the second predetermined engine speed.

4. The method of claim 3 additionally comprising sensing a third engine speed after reducing fuel delivery by the second fuel amount and restoring fuel delivery by a third fuel amount if the third engine speed is less than the second predetermined engine speed.

5. The method of claim 4, wherein the third fuel amount equals the second fuel amount.

6. The method of claim 2 additionally comprising sensing a third engine speed after sensing the second engine speed and stopping all fuel delivery to the engine if the third engine speed is greater than or equal to a third predetermined engine speed that is greater than the first and second predetermined engine speeds.

7. The method of claim 2, wherein reducing fuel delivery by the first delivery amount comprises stopping all fuel injection to one cylinder of the engine.

8. The method of claim 2, wherein reducing fuel delivery by the first delivery amount comprises reducing fuel injection to the engine by twenty percent.

9. The method of claim 8, wherein reducing fuel delivery to the engine by twenty percent comprises skipping one fuel injection cycle for every five normal fuel injection cycles of the engine.

10. A method of controlling a marine engine associated with a watercraft, the method comprising sensing a first engine speed, comparing the sensed engine speed with a first predetermined speed, reducing a power output of the engine by a first degree if the first sensed engine speed is above the first predetermined engine speed, sensing a second engine speed after reducing the power output of the engine by the first degree, restoring the power output of the engine by the first degree if the second sensed engine speed is below a second predetermined engine speed that is greater than the first predetermined engine speed.

11. The method of claim 10 additionally comprising further reducing the power output of the engine by a second degree if the second sensed engine speed is greater than or equal to the second predetermined engine speed.

12. The method of claim a 11 additionally comprising sensing a third engine speed after reducing further the power output of the engine and restoring power output of the engine by a third degree if the third engine speed is less than the second predetermined engine speed.

13. The method of claim 12, wherein the third degree equals the first degree.

14. The method of claim 10 additionally comprising sensing a third engine speed after sensing the second engine speed and stopping substantially all power output of the engine if the third engine speed is greater than or equal to a third predetermined engine speed that is greater than the first and second predetermined engine speeds.

15. The method of claim 10, wherein reducing the power output of the engine by the first degree comprises stopping all fuel delivery to one cylinder of the engine.

16. The method of claim 10, wherein reducing the power output of the engine by the first degree comprises reducing fuel delivery to the engine by twenty percent.

17. The method of claim 16 wherein reducing fuel delivery by twenty percent comprises skipping one fuel injection cycle for every five normal fuel injection cycles of the engine.

18. A method of controlling an engine of a planning-type watercraft that jumps out of the water, the method comprising sensing an engine speed, activating an engine speed limiting mode if the sensed engine speed is above a first predetermined speed, determining if a magnitude of a jump executed by the watercraft is of a first magnitude, a second magnitude that is greater than the first magnitude, or a third magnitude that is greater than the second magnitude, and an engine speed limiting means step which allows the engine to operate at a speed above the first predetermined speed during a jump of the second magnitude by increasing a power output of the engine.

19. A watercraft comprising a hull, an engine disposed within the hull, the engine comprising an engine body defining plural cylinders, an engine speed sensor configured to detect a speed of the engine, and a controller connected to the engine speed sensor and configured to control a power output of the engine, the controller being configured to detect a first engine speed, reduce the power output of the engine if the first engine speed is greater than a first predetermined engine speed, detect a second engine speed, and restore the power output of the engine if the second engine speed is less than a second predetermined engine speed that is greater than the first predetermined engine speed.

20. The watercraft of claim 19 additionally comprising a fuel injection system configured to inject fuel for combustion in the engine body, the controller being connected to the fuel injection system and configured to control the timing and duration of fuel injection by the fuel injection system.

21. The watercraft of claim 20, wherein the controller is configured to reduce fuel injection to reduce the power output of the engine.

22. A watercraft comprising a hull, an engine disposed within the hull, the engine comprising an engine body defining plural cylinders, an engine speed sensor configured to detect a speed of the engine, and means for detecting a first engine speed, reducing the power output of the engine if the first engine speed is greater than a first predetermined engine speed, detecting a second engine speed, and restoring the power output of the engine if the second engine speed is less than a second predetermined engine speed that is greater than the first predetermined engine speed.

* * * * *